US010988275B2

(12) United States Patent
Bean et al.

(10) Patent No.: US 10,988,275 B2
(45) Date of Patent: Apr. 27, 2021

(54) PACKAGE FEEDBACK CONTROL SYSTEM AND ASSOCIATED METHODS

(71) Applicant: Cryovac, LLC, Charlotte, NC (US)

(72) Inventors: Daniel D. Bean, Simpsonville, SC (US); William R. Wilson, Gary Court, SC (US)

(73) Assignee: Cryovac, LLC, Charlotte, NC (US)

( * ) Notice: Subject to any disclaimer, the term of this patent is extended or adjusted under 35 U.S.C. 154(b) by 0 days.

(21) Appl. No.: 16/613,244

(22) PCT Filed: May 17, 2018

(86) PCT No.: PCT/US2018/033128

§ 371 (c)(1),
(2) Date: Nov. 13, 2019

(87) PCT Pub. No.: WO2018/213539

PCT Pub. Date: Nov. 22, 2018

(65) Prior Publication Data

US 2020/0115090 A1 Apr. 16, 2020

Related U.S. Application Data

(60) Provisional application No. 62/508,471, filed on May 19, 2017.

(51) Int. Cl.
*B65B 57/14* (2006.01)
*B65B 3/28* (2006.01)
(Continued)

(52) U.S. Cl.
CPC ..... *B65B 57/145* (2013.01); *B65B 3/28* (2013.01); *B65B 9/207* (2013.01); *B65B 9/2007* (2013.01); *B65B 9/2014* (2013.01)

(58) Field of Classification Search
CPC ..... B65B 57/00; B65B 57/145; B65B 9/20; B65B 9/2007; B65B 9/2014; B65B 9/207; B65B 1/30; B65B 3/28
See application file for complete search history.

(56) References Cited

U.S. PATENT DOCUMENTS 4,230,195 A * 10/1980 Graffin ..... B65B 1/46 177/1
4,506,494 A 3/1985 Shimoyama et al.
(Continued)

FOREIGN PATENT DOCUMENTS

DE 1916267 U 5/1965
EP 1050460 A1 11/2000
(Continued)

OTHER PUBLICATIONS

Written Opinion of the International searching authority in PCT/US2018/033128 dated Nov. 22, 2018.

*Primary Examiner* — Robert F Long
*Assistant Examiner* — Eduardo R Ferrero
(74) *Attorney, Agent, or Firm* — Jon Isaacson

(57) ABSTRACT

A method and apparatus for producing product packages comprises operating first and second feedback control loops where product package weight is averaged and used to determine one of two possible adjustments to change the product fill rate and the volume of the product. The feedback loops operate in one of a plurality of index levels. The first feedback loop seeks to improve performance by making adjustments to the fill rate and volume of the product, while incrementally moving to more stable index levels requiring tighter tolerances and package weight averages based on more product packages. The second feedback loop seeks to preserve stability by making its own adjustments to the fill rate and volume of the product if large product package weight fluctuations are sensed. The second feedback loop
(Continued)

can move operation to less stable index levels having wider tolerances and package weight averages based on fewer product packages.

21 Claims, 4 Drawing Sheets

(51) Int. Cl.
*B65B 9/20* (2012.01)
*B65B 9/207* (2012.01)

(56) References Cited

U.S. PATENT DOCUMENTS 4,589,247 A 5/1986 Tsuruta et al.
4,630,654 A * 12/1986 Kennedy, Jr. ..... B65B 3/28 141/128
4,656,818 A 4/1987 Shimoyama et al.
4,749,008 A * 6/1988 Whitney ..... B65B 3/28 141/1
4,768,411 A 9/1988 Su
4,808,010 A 2/1989 Vogan
5,109,936 A 5/1992 Ruppel
5,148,841 A * 9/1992 Graffin ..... B65B 3/28 141/128
5,287,896 A * 2/1994 Graffin ..... B65B 3/28 141/1
5,467,581 A 11/1995 Everette
5,515,888 A * 5/1996 Graffin ..... B65B 3/28 141/1
6,244,747 B1 6/2001 Caudle
6,460,312 B1 * 10/2002 Nakagawa ..... B65B 9/20 53/493
8,453,686 B2 6/2013 Klaus et al.
8,561,375 B2 * 10/2013 Kiel ..... A21C 9/08 53/55
2005/0060963 A1 3/2005 Schubert et al.
2008/0209864 A1 * 9/2008 Fergusson ..... B65B 51/303 53/451
2014/0048170 A1 * 2/2014 Evans ..... B65B 29/00 141/12
2015/0019005 A1 * 1/2015 Moreira da Costa ... B65B 25/06 700/230
2018/0274969 A1 * 9/2018 Nagai ..... G01G 23/01

FOREIGN PATENT DOCUMENTS

GB 2270771 A 3/1994
WO 0023772 A1 4/2000

* cited by examiner

PACKAGE FEEDBACK CONTROL SYSTEM AND ASSOCIATED METHODS

FIELD OF THE INVENTION

The presently disclosed subject matter relates generally to a system and associated methods for controlling and maintaining consistency of the volume of product contained within product packages. More specifically, embodiments herein describe a feedback control system that can adjust package feed and product dispensing settings to maintain precise product volume control for systems that package the product within flexible pouches.

BACKGROUND

Vertical form/fill/seal (VFFS) packaging systems have proven to be very useful in packaging a wide variety of food and non-food pumpable and/or flowable products. Many vertical form/fill/seal systems are commercially available from manufacturers or suppliers such as Hayssen, Illipak, Kartridge Pak, DuPont and Fresco.

One example of such systems is the ONPACK™ family of flowable food packaging systems marketed by Cryovac/Sealed Air Corporation. The VFFS process is known to those of skill in the art, and described for example in U.S. Pat. No. 4,506,494 (Shimoyama et al.), U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), and U.S. Pat. No. 5,467,581 (Everette), all incorporated herein by reference in their entirety. Typically in such a process, lay-flat thermoplastic film is advanced over a forming device to form a tube, a longitudinal (vertical) fin or lap seal is made, and a bottom end seal is made by transversely sealing across the tube with heated seal bars. A liquid, flowable, and/or pumpable product, such as a liquid, semiliquid, or paste, with or without particulates therein, is introduced through a central, vertical fill tube to the formed tubular film. Squeeze rollers spaced apart and above the bottom end seal squeeze the filled tube and pinch the walls of the flattened tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the midpoint of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertical form/fill/seal pouches which have a bottom end and top end heat seal closure.

The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. A commercial example of an apparatus embodying this more simplified process is the ONPACK™ 3002 VFFS packaging machine marketed by Cryovac/Sealed Air Corporation. In either type of VFFS process, variations in the volume of product filling the individual pouches is undesirable. Thus, it would be desirable to provide more precise product volume control in these conventional systems.

SUMMARY

Embodiments of the presently disclosed subject matter are directed to a method and apparatus for producing product packages comprising operating first and second feedback control loops where product package weight is averaged and used to determine one of two possible adjustments to change the fill rate of the product package and the volume of the product. The feedback loops operate in one of a plurality of index levels. The first feedback loop seeks to improve performance by making adjustments to the fill rate and volume of the product, while incrementally moving to more stable index levels requiring tighter tolerances and package weight averages based on more product packages. The second feedback loop seeks to preserve stability by making its own adjustments to the fill rate and volume of the product if large product package weight fluctuations are sensed. The second feedback loop can move operation to less stable index levels having wider tolerances and package weight averages based on fewer product packages.

In one embodiment, a method is disclosed for producing on an apparatus a plurality of product packages by adjusting on an ongoing basis a fill rate at which the product is filled and a corresponding product volume contained within the pouch. While operating the apparatus in one of a plurality of index levels, the method comprises forming, filling, and sealing the product packages using initial values for the fill rate and the volume and measuring a weight of the product packages as they are produced by the apparatus. In a first feedback control loop, the method may comprise calculating, based in part on the measured weights, a first adjusted measure of the fill rate and a first adjusted measure of the volume, and comparing the first adjusted measure of volume against a plurality of first threshold levels, each first threshold level corresponding to one of the plurality of index levels, the first threshold levels comprising a widest first threshold range at a first index level and a narrowest first threshold range at a second index level. In a second feedback control loop, the method may comprise calculating, based in part on the measured weights, a second adjusted measure of the fill rate and a second adjusted measure of the volume and comparing the measured weight against a plurality of second threshold levels, each second threshold level corresponding to one of the plurality of index levels, the second threshold levels comprising a widest second threshold range at the first index level and a narrowest second threshold range at the second index level. The plurality of first and second threshold levels may comprise more than two levels with intermediate levels between the first and second index levels having tolerance ranges between the narrowest and widest tolerance ranges.

If the first adjusted measure of volume is within a first threshold level corresponding to a current index level, the apparatus may be adjusted using the first adjusted measure of the fill rate and the first adjusted measure of the volume and the index level may be changed in a direction from the first index level towards the second index level. The index level change in this direction may be changed by a single index level. Conversely, if the first adjusted measure of volume is outside of the current first threshold level corresponding to the current index level, the apparatus may be adjusted using the first adjusted measure of the fill rate and the first adjusted measure of the volume and the index level may be changed in a direction from the second index level towards the first index level. The index level change in this direction may be changed by one or more index levels. If however, the measured weight is outside of a current second threshold level corresponding to the current index level, the apparatus may be adjusted using the second adjusted measure of the fill rate and the second adjusted measure of the volume and the index level may be changed by one or more levels in the direction from the second index level towards the first index level.

In one embodiment, the first and second adjusted measures of the volume are an adjusted squeeze close length and the first and second adjusted measures of the fill rate are an adjusted pump speed of a pump that dispenses product into the pouch. In one embodiment, the step of calculating the first adjusted measure of the fill rate and the first adjusted measure of the volume comprises averaging a different number of the measured weights for each of the plurality of index levels, including averaging a smallest number of the measured weights at the first index level and averaging a largest number of the measured weights at the second index level. Similarly, the step of calculating the second adjusted measure of the fill rate and the second adjusted measure of the volume comprises averaging a different number of the measured weights for each of the plurality of index levels, including averaging a smallest number of the measured weights at the first index level and averaging a largest number of the measured weights at the second index level. For a given index level, the step of calculating the second adjusted measure of the fill rate and the second adjusted measure of the volume comprises averaging a first number of the measured weights and the step of calculating the first adjusted measure of the fill rate and the first adjusted measure of the volume comprises averaging a larger second number of the measured weights. In one embodiment, these steps may be implemented as a computer program for instructing a computer to perform the method.

Another embodiment comprises a computer-implemented method for producing on an apparatus a plurality of product packages by adjusting on an ongoing basis a fill rate at which the product is filled and a corresponding product volume contained within the pouch. The computer implemented method may be executed on a processor and comprise operating the apparatus in one of a plurality of index levels, and at each level forming, filling, and sealing the product packages using initial values for the fill rate and the volume and measuring a weight of the product packages as they are produced by the apparatus. In a first feedback control loop, the processor may calculate, based in part on the measured weights, a first adjusted measure of the fill rate and a first adjusted measure of the volume and compare the first adjusted measure of volume against a plurality of first threshold levels, each first threshold level corresponding to one of the plurality of index levels, the first threshold levels comprising a widest first threshold range at a first index level and a narrowest first threshold range at a second index level. In a second feedback control loop, the processor may calculate, based in part on the measured weights, a second adjusted measure of the fill rate and a second adjusted measure of the volume and compare the measured weight against a plurality of second threshold levels, each second threshold level corresponding to one of the plurality of index levels, the second threshold levels comprising a widest second threshold range at the first index level and a narrowest second threshold range at the second index level.

If the first adjusted measure of volume is within a first threshold level corresponding to a current index level, the processor may adjust the apparatus using the first adjusted measure of the fill rate and the first adjusted measure of the volume and change the index level by a single index level in a direction from the first index level towards the second index level. In contrast, if the first adjusted measure of volume is outside of the current first threshold level corresponding to the current index level, the processor may adjust the apparatus using the first adjusted measure of the fill rate and the first adjusted measure of the volume and change the index level by one or more index levels in a direction from the second index level towards the first index level. However, if the measured weight is outside of a current second threshold level corresponding to the current index level, the processor may adjust the apparatus using the second adjusted measure of the fill rate and the second adjusted measure of the volume and change the index level by one or more index levels in a direction from the second index level towards the first index level.

In one embodiment, the first and second adjusted measures of the volume are an adjusted squeeze close length. In one embodiment, the first and second adjusted measures of the fill rate are an adjusted pump speed of a pump that dispenses product into the pouch. In one embodiment, the step of calculating the first and second adjusted measures of the fill rate and the first and second adjusted measures of the volume comprises averaging a different number of the measured weights for each of the plurality of index levels, including averaging a smallest number of the measured weights at the first index level and averaging a largest number of the measured weights at the second index level. At a given index level, the step of calculating the second adjusted measure of the fill rate and the second adjusted measure of the volume comprises averaging a first number of the measured weights and the step of calculating the first adjusted measure of the fill rate and the first adjusted measure of the volume comprises averaging a larger second number of the measured weights.

Another embodiment comprises an apparatus for producing a plurality of product packages by a process of forming product pouches from a film, filling the pouches with a product, and sealing the product pouches to form the product packages, the apparatus comprising a film feed controller and feed mechanism in contact with the film to advance the film a desired amount to create a pouch having a desired volumetric capacity, a product dispense controller disposed to supply a desired, adjustable volume of product to the pouches formed from the film, a squeeze controller and squeeze mechanism in contact with the film to restrict a flow of product supplied by the dispense controller into the pouches formed from the film, a product package scale disposed in-line with a conveyor system that carries the product packages away from the apparatus, the product package scale measuring a weight of the product packages produced by the apparatus, and a computer processor adapted to operate at least first and second feedback loops. The processor may operate the first feedback control loop and second feedback control loop in one of a plurality of index levels. The processor may receive the weight of the product packages and calculate, in the first feedback loop, a first average of the weights and determine a first squeeze controller adjustment and optionally a first product dispense controller adjustment. In parallel the processor may calculate, in the second feedback loop, a second average of the weights and determine a second squeeze controller adjustment and optionally a second product dispense controller adjustment. In the first feedback loop, the processor may compare the first squeeze controller adjustment against a plurality of first threshold levels, each first threshold level corresponding to one of the plurality of index levels, the first threshold levels comprising a widest first threshold range at a first index level and a narrowest first threshold range at a second index level. In the second feedback loop, the processor may compare the second average of the weights against a plurality of second threshold levels, each second threshold level corresponding to one of the plurality of index levels, the second threshold levels comprising a widest second threshold range at the first index level and a narrowest second threshold range at the second index level.

If the first squeeze controller adjustment is within a first threshold level corresponding to a current index level, the processor may apply the first squeeze controller adjustment and optionally the first product dispense controller adjustment to the production of new product packages and change the index level by a single index level in a direction from the first index level towards the second index level. If instead the first squeeze controller adjustment is outside of the current first threshold level corresponding to the current index level, the processor may apply the first squeeze controller adjustment and optionally the first product dispense controller adjustment to the production of new product packages and change the index level by one or more index levels in a direction from the second index level towards the first index level. However, if the second average of the weights is outside of a current second threshold level corresponding to the current index level, the processor may apply the second squeeze controller adjustment and optionally the second product dispense controller adjustment to the production of new product packages and change the index level by one or more index levels in a direction from the second index level towards the first index level.

In one embodiment, the steps of calculating the first and second averages of the weights comprises averaging a different number of the measured weights at each of the plurality of index levels, including averaging a smallest number of the measured weights at the first index level and averaging a largest number of the measured weights at the second index level. In one embodiment, the second average of the weights is calculated from a smaller number of package weights than the first average of the weights.

DETAILED DESCRIPTION

I. General Considerations

Figure 1:
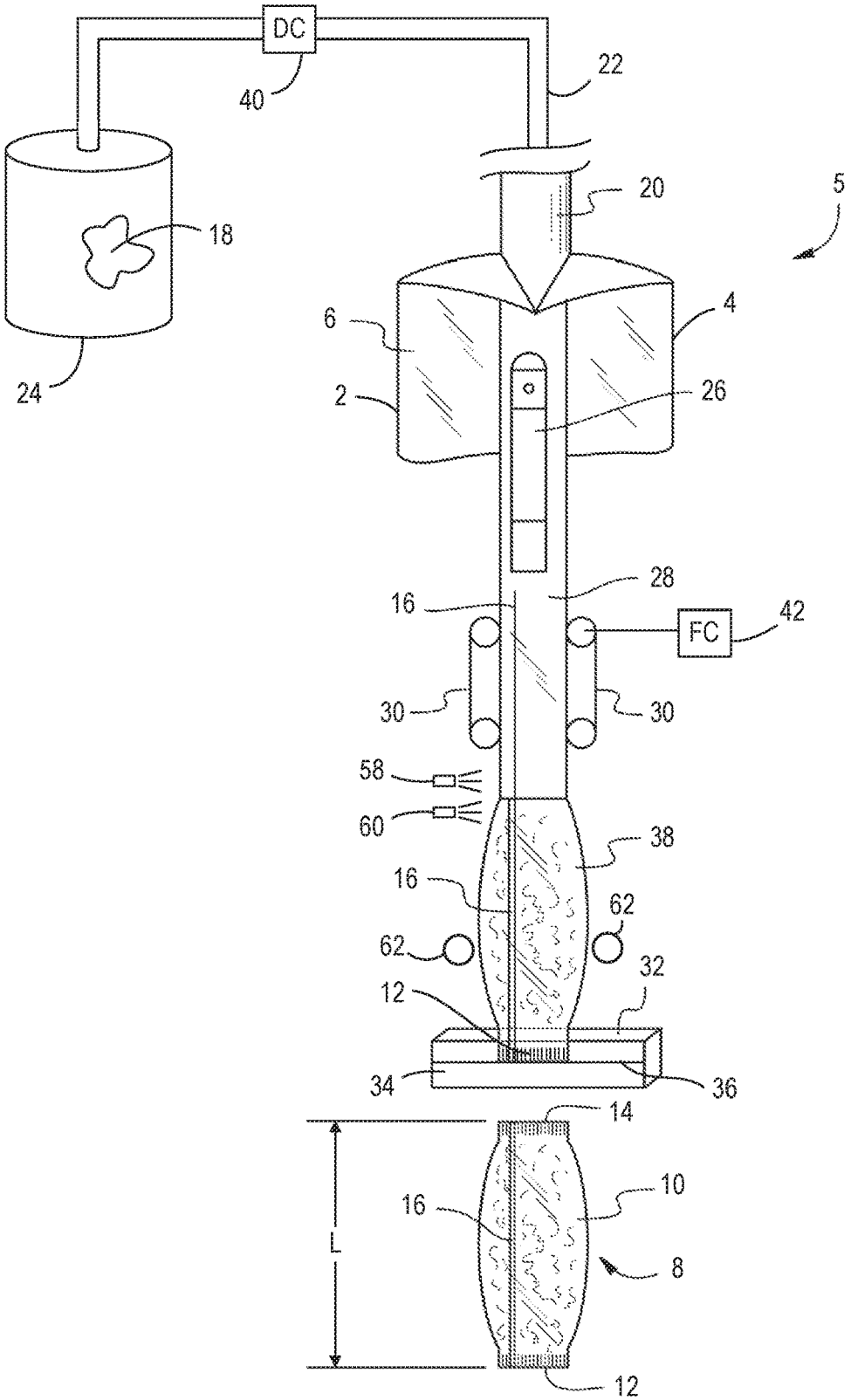
FIG. 1 is a diagrammatic representation of a VFFS process and apparatus for making a package in accordance with some embodiments of the presently disclosed subject matter.

The presently disclosed subject matter provides a system and associated methods for controlling and maintaining consistency in the volume of product contained within product packages. Embodiments herein describe a feedback control system that can adjust package feed timing and product dispensing settings to maintain precise product volume control for systems that package the product within flexible pouches. For instance, Vertical form/fill/seal (VFFS) packaging systems may feed a tube of film a desired length to create a pouch having a desired volumetric capacity. Such VFFS packaging systems may also use a pair of squeeze rollers to precisely control the volume of product contained within a given length of a pouch. The VFFS packaging system may also dispense the product into the pouch at a desired rate so that each pouch is filled with a desired volume of product. The filled pouch is sealed and cut to form a final package. Embodiments herein describe a feedback control system that tracks a characteristic of the packages and continually adjusts the product volume and dispensing rate to achieve consistent product volumes contained within the packages.

II. Definitions

Following long standing patent law convention, the terms "a", "an", and "the" refer to "one or more" when used in the subject application, including the claims. Thus, for example, reference to "a film" includes a plurality of such films, and so forth.

As used herein, the term "film" can be used in a generic sense to include a thermoplastic film, laminate, sheet, or web, either multilayer or monolayer, and of any suitable thickness that may be used in connection with the present invention.

The term "filled" as used herein refers to an item (such as a pouch) that has been occupied with a product in a manner consistent with a commercial filling operation. Thus, a pouch may or may not be 100% filled.

The term "flexible" is used herein to refer to materials that are pliable and easily deform in the presence of external forces. In some embodiments, suitable flexible materials can be characterized by a modulus of less than about 50,000 PSI and in some embodiments less than 40,000 PSI (ASTM D-872-81).

As used herein, the term "pouch" refers to any of the wide variety of containers known in the art, including (but not limited to) bags, packets, packages, and the like.

As used herein, the term "seal" refers to any seal of a first region of an outer film surface to a second region of an outer film surface, including heat or any type of adhesive material, thermal or otherwise. In some embodiments, the seal can be formed by heating the regions to at least their respective seal initiation temperatures. The sealing can be performed by any one or more of a wide variety of methods, including (but not limited to) using a heat seal technique (e.g., melt-bead sealing, thermal sealing, impulse sealing, dielectric sealing, radio frequency sealing, ultrasonic sealing, hot air, hot wire, infrared radiation).

Any direction referred to herein, such as "top," "bottom," "left," "right," "upper," "lower," and other directions and orientations are described for clarity in reference to the figures and are not to be limiting. It is to be understood that the films or systems described herein can be used in a wide variety of directions and orientations.

All compositional percentages used herein are presented on a "by weight" basis, unless designated otherwise.

Although the majority of the above definitions are substantially as understood by those of skill in the art, one or more of the above definitions can be defined hereinabove in a manner differing from the meaning as ordinarily understood by those of skill in the art, due to the particular description herein of the presently disclosed subject matter.

III. The Disclosed Dispensing System

FIG. 1 schematically illustrates a VFFS apparatus 5 that can be used in the process of making a product filled package 8 in accordance with the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), U.S. Pat. No. 5,467,581 (Everette), and U.S. Pat. No. 6,244,747 (Caudle), all incorporated herein by reference in their entirety.

Apparatus 5 utilizes a lay-flat film 6 to create a flexible container for the product 18. Product 18 is manually or mechanically supplied to the upper end portion of forming tube 20 via any conventional means, such as a funnel or dispensing line 22. In the embodiment shown, product 18 is supplied to the VFFS apparatus 5 from a product container 24. The product 18 can be any food or non-food product, liquid, semi-liquid, or paste, e.g. flowable or pumpable high acid or low acid foods, such as tomato products, milk or dairy products, medical products, or the like.

Packages are formed in a lower portion of apparatus 5. Film 6 from which the packages are formed is advanced from a feed roller (not shown), over forming tube 20 (sometimes known as a "sailor's collar" or "forming collar"). As the film 6 passes over the forming tube 20, opposite first 2 and second 4 sides of the film 6 are brought together and subsequently joined with a longitudinal seal 16 formed by longitudinal heat sealing device 26. Once the longitudinal seal 16 is formed, the film 6 takes the shape of a vertically-oriented film tube 28. In general, the film 6 will travel vertically downward from the forming tube 20 towards the lower portion of apparatus 5, where transverse heat seal bars 32, 34 operate to close and seal horizontally across the lower end of film tube 28, to form a pouch 10 having a first transverse seal 12. Pouch 10 is thereafter filled with product 38.

Film feed mechanism 30, powered and directed by rollers and/or a belt, as illustrated, or by a suitable alternative motive device, advances the film tube 28 and pouch 10 downward a predetermined distance to create a pouch 10 having a length L. Squeeze rollers (not shown) may be incorporated to close on the moving film in order to meter the amount of product in the pouch and to void/clean the area where a transverse seal is to be applied. Seal bars 32, 34 close and seal horizontally across the lower end of film tube 28 to form a first transverse seal 12 at the bottom of the film tube 28, while simultaneously sealing horizontally across upper end of sealed pouch 10 to form a second transverse seal 14. The next pouch 38 above, is then filled with a metered quantity of product 18, then advanced downwardly, and the packaging cycle is repeated. A cut-off knife 36 may be situated between upper 32 and lower 34 seal bars to sever a lower sealed pouch 10 from the bottom of upstream pouch 38.

Notably the VFFS apparatus 5 shown in FIG. 1 includes a dispense controller 40 that controls the amount and/or rate at which the product 18 is dispensed into the film tube 28. Thus, the dispense controller 40 can adjust the volume of product dispensed per package 8. The dispense controller 40 may be a pump or a pump controller that adjusts the volume and flow rate for the product 18 delivered from container 24 through the dispensing line 22 and into the pouch 10 within the VFFS apparatus 5. The pump may be any suitable device that moves product 18 by mechanical action and can include an of a variety of pump types, including for example positive displacement pumps, velocity pumps, centrifugal pumps, or gravity pumps. A suitable pump controller may alter the operation of a pump to change the volume and flow rate for the product 18 delivered by such a pump. For instance, a pump controller may change the pump operating speed, operating pressure, or pump duty cycle. A pump controller may alter the operation of a pump by altering an operating voltage, signal modulation, or by digital signal processing. Alternatively, the dispense controller 40 may be implemented as a valve or other flow restrictor in conjunction with a flow meter or other solutions that can accurately control the volume and flow rate for the product 18 delivered to the film tube 28.

The VFFS apparatus 5 also includes a feed controller 42 that controls the length and/or rate at which the film tube 28 translated downward through the VFFS apparatus 5. Thus, the feed controller 42 can adjust the length L (and hence the overall capacity) of the packages 8. The feed controller 42 may be a motor or a motor controller that adjusts the translation length or rate for the film tube 28 within the VFFS apparatus 5. The motor may be any suitable device that causes the film feed mechanism 30 to advance the film tube 28 a desirable, but adjustable length L. Examples of motors that might be used in this application include servo motors, stepper motors, DC motors. A suitable motor controller may alter the operation of a motor to change the feed length or rate for the film tube 28 advanced by the feed mechanism 30. For instance, a motor controller may change the motor operating speed, motor duty cycle, or the duration of time that a motor operates. A motor controller may alter the operation of a motor by altering an operating voltage, signal modulation, or by digital signal processing. The motor controller may be a micro controller or a dedicated control circuit. Alternatively, the feed controller 42 may be implemented as mechanical clutch, or a temporarily engageable drive train translated by a solenoid for example, or other electro-mechanical solutions that can accurately control the feed length or rate for the film tube 28 within the VFFS apparatus 5.

Figure 6A:
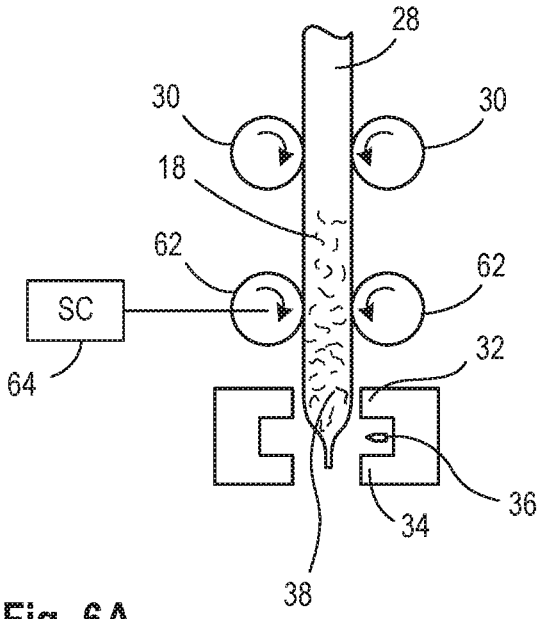
FIGS. 6A and 6B are schematic views representing operation of squeeze rollers, seal bars, and cut off knife on a VFFS apparatus in accordance with some embodiments of the presently disclosed subject matter.
Figure 6B:
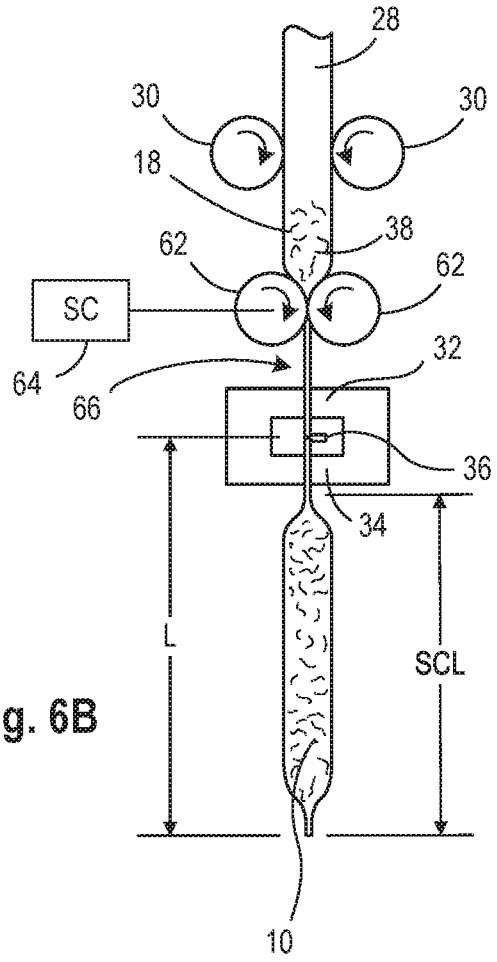

Precise control of the volume of product 18 that fills a given pouch 10 may be managed with squeeze rollers 62 and a squeeze length controller 64 shown in FIGS. 6A & 6B. As described above, a packaging cycle may begin with a cut-off knife 36 situated between upper 32 and lower 34 seal bars severing a lower sealed pouch 10 from the bottom of upstream pouch 38. Other embodiments may include a two-stage process where the creation of a transverse heat seal occurs at one stage in the process, and then, downstream of the first stage, a separate pair of cooling/clamping bars contact the just-formed transverse heat seal to cool and strengthen the seal just prior to separating the lower pouch 10 from the upstream pouch 38. In either approach, the upstream pouch 38 that is filled or is being filled with product 18 is advanced by feed mechanism 30 past a pair of opposed squeeze rollers 62 and also past the seal bars 32, 34 and cut-off knife 36 to the position shown in FIG. 6B where the pouch 10 has a desired length L.

At a predetermined time before the pouch 10 reaches the position shown in FIG. 6B, the squeeze length controller 64 causes the squeeze rollers 62 to move from the separated position shown in FIG. 6A towards the closed position shown in FIG. 6B. The squeeze rollers 62 roll in synchronization with the feed mechanism 30 so that the film tube 28 does not stretch or crumple. In moving to the closed position, the squeeze rollers 62 cause the film tube 28 to collapse and evacuates product 18 from the top of lower pouch 10. After closing, the squeeze rollers 62 continue to rotate, keeping product 18 above the squeeze rollers 62 within the upstream pouch 38, and allowing an evacuated region 66 of the film tube 28 to reach the seal bars 32, 34 and cut-off knife 36. Once the lower pouch 10 moves to the desired position where the pouch has a length L, the seal bars 32, 34 seal the top of pouch 10 and bottom of pouch 38 and the cut-off knife separates the lower pouch 10 from the upstream pouch 38. Around the time the pouches 10, 38 are separated and the seal bars 32, 34 separate from the pouch 10, the squeeze rollers 62 move once again to the open position shown in FIG. 6A, which allows product 18 to fill the upstream pouch 38.

In one or more embodiments, the squeeze controller 64 causes the squeeze rollers 62 to close when the bottom of the lower pouch 10 has moved a predetermined, but adjustable length past the squeeze rollers. This length is referred to as a Squeeze Close Length and is referred to herein as "SCL" and represented by the dimension SCL in FIG. 6B. The SCL dimension can be increased by delaying the time at which the squeeze rollers 62 close. Similarly, the SCL dimension can be decreased by advancing the time at which the squeeze rollers 62 close. Several techniques may be used to determine the time at which the squeeze rollers 62 close. The closing trigger may be determined by a simple countdown timer, with knowledge of the speed at which the pouch 10 is moving downward through the VFFS apparatus 5. In another embodiment, the squeeze rollers 62 may close after the rollers have rotated a certain number of rotations. In another embodiment, the squeeze rollers 62 may close in response to a sensed position of the pouch 10, such as with optical sensors, cameras, and/or image processing programs. Regardless, the SCL and the diameter of the film tube 28 determine the volume of product 18 contained within the individual pouches 10. Therefore, in one or more embodiments, the SCL may be adjusted on an ongoing basis using a feedback control system to achieve consistent product volumes contained within the packages 8.

The squeeze controller 64 may be an actuator or an actuator controller that adjusts the position of the squeeze rollers 62 within the VFFS apparatus 5. The actuator may be any suitable device that causes the squeeze rollers to move between the open and closed positions. Examples of actuators that might be used in this application include servo motors, stepper motors, DC motors, linear motors, solenoids and the like. A suitable actuator controller may be an electrical circuit, microcircuit, power relay and the like that controls, changes, or enables the operation of an actuator. Since the squeeze controller 64 manages the time at which the squeeze rollers 62 engage or disengage, a digital or analog timer may be used to implement changes in SCL. In one embodiment, the squeeze rollers 62 and squeeze controller 64 are linked by a drivetrain that may include, for example, gears, arms, bearing, springs and the like. Those skilled in the art will appreciate a number of means for carrying out the function and operation of the squeeze roller 62.

IV. Feedback Control System Hardware

Figure 2:
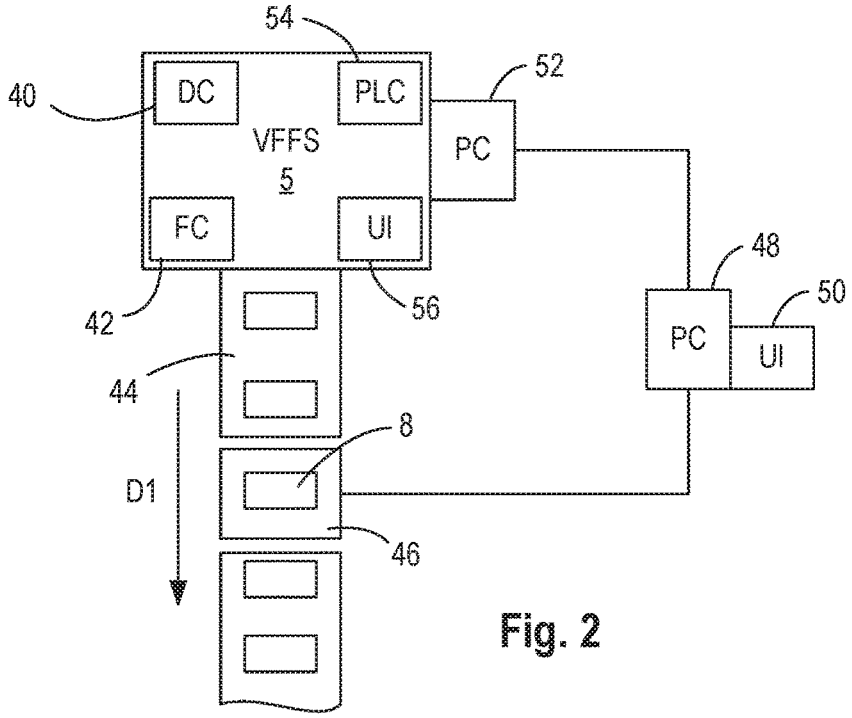
FIG. 2 is an electro-mechanical schematic representation of a VFFS process and apparatus for making a package in accordance with some embodiments of the presently disclosed subject matter.

FIG. 2 illustrates a schematic representation of the VFFS apparatus 5 and associated electrical or mechanical hardware used in carrying out embodiments of the invention. The VFFS apparatus 5 includes a user interface 56 that allows a user to enter and adjust a variety of operating settings, including for example, target weights, units, package sizes, machine speed and the like. In normal operation, the VFFS apparatus 5 will continually produce packages 8 filled with product 18. These packages 8 are delivered to a conveyor system 44 that carries the packages 8 towards a collection bin, for example, or optionally to operators, who may prepare the packages 8 for use or transport or other post-processing. Since the packages 8 are sealed, precise volume measurements of the product 18 are impractical and would require opening the pouch 10. A more efficient, timely, in-situ measurement of the product volume in each pouch 8 may be obtained indirectly with a weight reading. Thus, the conveyor system 44 may include an in-line scale 46 that is able to quickly and accurately measure the weight of each package 8 that moves onto the scale 46. The scale 46 may be a conveyor scale adapted to weigh the packages 8 while actively or passively conveying the package 8 from an upstream part of the conveyor 44 to a downstream part of the conveyor 44 in a direction indicated by the arrow D1. In some embodiments, the scale 46 may be implemented as a belt weigher, a conveyor scale, and the like. In some embodiments, the scale 46 may use strain gauges, piezoelectric elements, or electromagnetic force restoration load cells and the like.

The scale 46 may include a dedicated scale computer 48 and optionally a user interface 50 to manage such tasks as calibration, zeroing, or adjusting timing of the weights. In one embodiment, the scale computer 48 may match timing of the VFFS apparatus 5. In one embodiment, the scale computer 48 may simply provide package 8 weights as they are read by the scale 46. In some embodiments, the computer 48 may take multiple measurements of a single package 8 while it is traversing the scale 46 and calculate a weight average. Moreover, since the package 8 is moving across the scale 46 leading to signal variations, the computer 48 may process or filter readings from the scale 46 for improved accuracy.

Ultimately, the measured weight for individual packages 8 is transmitted by the computer 48 to the VFFS apparatus 5, and particularly to a VFFS computer 52 that tracks and uses the weights of the packages 8 to make ongoing minor adjustments to the dispense controller 40 and squeeze controller 64 to provide consistent, repeatable package 8 weights (and volume). Communications between the scale 46 and computers 48, 52 may be provided through commonly known peripheral bus channels, including for example serial buses, USB, RS-232, I2C or other communications infrastructures, such as Ethernet or wireless protocols including, for example, Bluetooth, WiFi, NFC, and the like. In the embodiment shown, the scale computer 48 and VFFS computer 52 are depicted as separate elements. In another embodiment, the function and operation of each may be implemented on a single, shared computer.

As will be discussed in detail below, the VFFS computer 52 tracks separate product weight averages to determine how far the product weights stray from an expected or desired value. These two separate product weight averages, referred to herein as an indexing average and a rolling average respectively form a part of separate, independent feedback loops that are each capable of effecting changes to the dispense controller 40 and squeeze controller 64. Changes to the dispense controller 40 and squeeze controller 64 that produce a corresponding change in product dispense volume are applied by writing adjusted control settings to a programmable logic controller (PLC) 54 or other process controller. The PLC 54 controls the dispense controller 40 and squeeze controller 64 with the new, adjusted settings to produce new packages 8. The new packages 8 are weighed at scale 46 and the feedback process continues.

IV. Package Adjustment Calculations

The adjustment settings that are applied to the dispense controller 40 and squeeze controller 64 may be based on average measured weights from a predetermined number of preceding packages 8 produced by the VFFS apparatus 5. As discussed above, the weights are collected and measured as data correlating to the desired volume in the packages 8. An accurate correlation may require some information about the product 18, which an operator can provide by entering information into the user interface 56. One piece of information that is used in calculating appropriate dispense rate and squeeze roller timing is the density of the product at the dispensing temperature. An operator may use the scale 46 to measure the weight of a unit volume of product 18. For example, the operator may weigh a gallon of product 18 and enter this weight into the user interface 56. With the weight of the product 18 entered, density is merely calculated by the quotient of weight divided by volume.

$$\text{Density}=\text{Measured Weight}/\text{Volume Weighed} \quad (1)$$

With the density known, the expected weight of a volume of product is also calculable as the product of desired volume and product density.

$$\text{Expected Weight}=\text{Desired Volume}\times\text{Density} \quad (2)$$

Pouch 10 size may be another piece of information that an operator can provide at the user interface 56. The length L of a pouch 10 that can hold the desired volume of product 18 will depend on the diameter of the forming tube 20. The forming tube 20 determines the diameter of the film tube 28 that is sealed to create individual pouches 10. The VFFS apparatus 5 can run with different size forming tubes 20 to accommodate different size packages 8. If the forming tube 20 is identified by circumference, then the cross section area of the resulting film tube 28 is determined by:

$$\text{Cross Section Area}=\text{Circumference}^2/4\pi \quad (3)$$

Alternatively, if the forming tube 20 is identified by diameter, then the cross section area of the resulting film tube 28 is determined by:

$$\text{Cross Section Area}=(\pi\times\text{Diameter}^2)/4 \quad (4)$$

In either case, an initial assumption about a desired SCL, given the calculated cross section of the film tube 28, may be provided by:

$$\text{SCL}=\text{Desired Volume}/\text{Cross Section Area} \quad (5)$$

This initial estimate for SCL is based on a perfectly shaped cylinder. However, since the pouches 10 are sealed at first and second transverse seals 12, 14 (see FIG. 1), the product 18 contained within the pouch 10 will not assume the shape of a perfect cylinder. Thus, the initial estimate for SCL can be modified, perhaps by some nominal percentage increase to account for the package 8 shape. In any case, the SCL of the packages 8 will be updated as necessary by the weight feedback control process described below. Specifically, a change in SCL can be requested by setting a new SCL value in the PLC 56, which then controls the squeeze controller 64 to close the squeeze rollers 62 at a delayed or advanced time to create pouches 10 having a new product volume. Accordingly, a rough initial estimate of the SCL is sufficient.

By combining equations (2) and (5) above, we can obtain the following relationship between SCL and weight:

$$\text{SCL}=\text{Weight}/(\text{Density}\times\text{Cross Section Area}) \quad (6)$$

One may use equation (6) as a basis for changing the pouch SCL based on a difference (ΔWeight) between the expected weight and a measured or averaged actual weight (i.e., (ΔWeight=expected−actual). That is:

$$\Delta\text{SCL}=\Delta\text{Weight}/(\text{Density}\times\text{Cross Section Area}*\Delta AF1) \quad (7)$$

where AF1 is an adjustment factor that can be used to modify the SCL adjustment settings that are actually written to the PLC 54. Since large scale changes may tend to make the VFFS apparatus 5 unstable, small adjustments may be desirable. Accordingly, the adjustment factor AF1 can be made larger, thus making the proposed change in squeeze close length (ΔSCL) smaller. Some representative values for AF1 are discussed in greater detail below and shown in Table I. If packages 8 are weighed and determined to be underweight, then the measured weight difference (ΔWeight) will be a positive value and equation (7) will also produce a positive value for ΔSCL to delay the time at which the squeeze rollers 62 close and allow more product 18 into the pouch 10. Similarly, if packages 8 are weighed and determined to be overweight, then the measured weight difference (ΔWeight) will be negative and equation (7) will also produce a negative value for ΔSCL, which will advance the time at which the squeeze rollers 62 close and reduce the volume of product 18 in the pouch 10.

In writing a change in SCL to PLC 54, a corresponding change in product 18 fill speed or fill rate can also be made so that the overall speed of the VFFS 5 can be maintained. That is, if packages 8 are determined to be overweight, then a shorter SCL can be requested and product can be dispensed by PLC 54 and dispense controller 40 at a lower rate. Similarly, if packages 8 are determined to be underweight, then a longer SCL can be requested and product can be dispensed by PLC 54 and dispense controller 40 at a faster rate.

In one embodiment, it is desirable to link or associate the amount of change in SCL implemented by squeeze controller 64 to a corresponding change in fill rate implemented by the dispenser controller 40. In one embodiment, the dispenser controller 40 adjusts a pump speed to control the amount and/or rate at which the product 18 is dispensed into the film tube 28. Thus, a faster pump speed will provide a larger volume of product 18 into the pouches 10 in a given amount of time. Likewise, a slower pump speed will fill a smaller volume of product 18 into the pouches 10 in the same amount of time. In one embodiment, a percentage or ratio of change in SCL can be applied equally as a change in pump speed, such as:

$$\text{New Speed/Old Speed=New SCL/Old SCL=Length Ratio} \quad (8)$$

Where Length Ratio is merely a ratio of the new SCL to the old SCL. As discussed above, it may be desirable to slightly reduce the change to maintain system stability. Thus, the length ratio, which is already somewhat close to 1:1, may be modified with an adjustment ratio AF2, that adjusts the ratio even closer to 1:1. For example, a modified speed ratio may be expressed as:

$$\text{Speed Ratio}=1+AF2\times(\text{Length Ratio}-1) \quad (9)$$

where AF2 is some number less than one and may vary or remain static. Some experimentation has shown that a value of about 0.9 produces stable results. However, in other embodiments, an adjustment factor for calculating a new pump speed may be in the range between 0.8 and 0.99. With this modified Speed Ratio, the new pump speed may be determined by:

$$\text{New Speed=Old Speed}\times\text{Speed Ratio} \quad (10)$$

The dispenser controller 40 may be programmed to receive a speed change instead of an absolute speed value. Accordingly, the speed change may be expressed as:

$$\Delta\text{Speed=Old Speed}\times AF2\times(\text{Length Ratio}-1) \quad (11)$$

In summary, the preceding has shown how a difference (ΔWeight) between an expected weight and a measured or averaged actual weight can be used to calculate a desired change in squeeze close length (ΔSCL) to change the product volume within the pouches 10 and, in turn, also calculate a desired change in pump speed (ΔSpeed) to change the rate at which product 18 fills the new pouches 10. In the calculations described above, the change in SCL (ΔSCL) is determined first and that change in SCL is then used to calculate a change in pump speed (ΔSpeed). In another embodiment, the adjustment to SCL may be the only adjustment made in response to the feedback control process. In another embodiment, the change in pump speed may be calculated first and that pump speed change may be used to calculate a corresponding change in SCL.

V. Feedback Control Process

Figure 3:
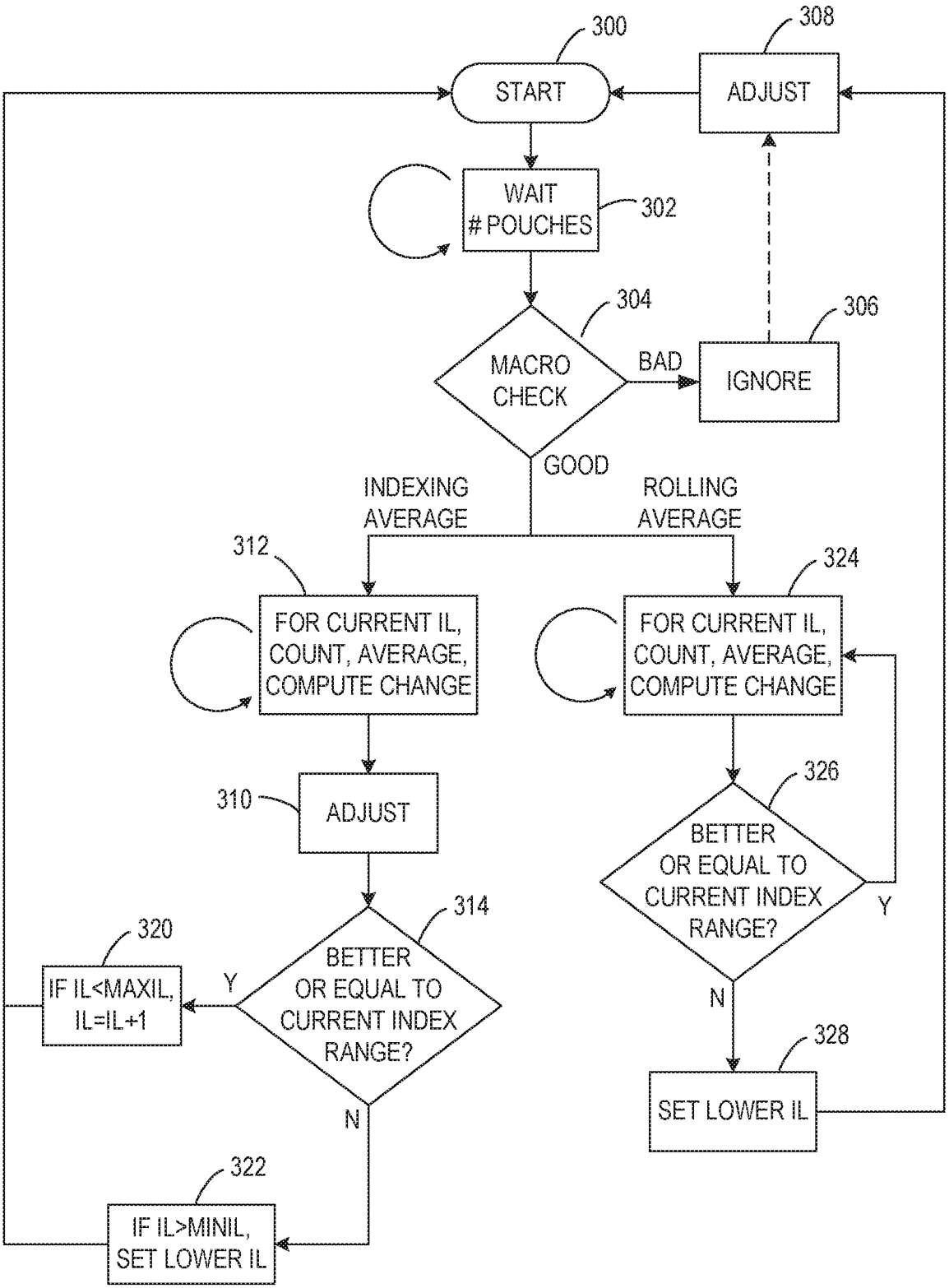
FIG. 3 is a process flow diagram, including parallel feedback control loops for a VFFS process and apparatus for making a package in accordance with some embodiments of the presently disclosed subject matter.

FIG. 3 illustrates a process flow diagram for the package weight feedback control system implemented by the VFFS apparatus 5 using the hardware configuration shown in FIG. 2. The process begins at step 300, which may correspond to an initial power up and running of the VFFS apparatus 5 or a process restart following a setting change based on prior package 8 weight measurements. In either case, a wait time is enforced at step 302, which allows newly initialized or newly changed settings to be applied to newly formed packages 8 and further allow those packages 8 to reach the scale 46. For instance, FIG. 2 shows that two packages 8 are positioned on the conveyor 44 between the VFFS apparatus 5 and the scale 46. Thus, a wait time of 3 pouches may be enforced at step 302.

Next, at step 304, the system may implement one or more global or macro checks to verify that packages 8 are being produced as expected. For instance, the system may verify that the package weights are within a very wide tolerance range (e.g., 25%-35% of expected weight) before using a particular weight in the feedback calculations. Though not common, it is possible for package weights to stray outside of this wide tolerance range. This may occur, for instance, when particulates or air pockets in the product 18 cause temporary fluctuations in dispensing volume. When such variations occur, the system will ignore the outlier data points (step 306) as not being a true indication of the package weights produced by the current settings.

Alternatively, or in addition to a wide tolerance range check, the VFFS apparatus 5 may also check to verify that a sufficient amount of product is filling the pouches 10 regardless of particular run settings. It is generally desirable for product integrity and shelf-life reasons for the product 18 to substantially fill the pouch 10. To achieve this, the dispense controller 40 should fill the film tube 28 with product 18 to a level that is above squeeze rollers 62. Of course, the product 18 should not rise to a level that is too high within the film tube 28 as to pose a spill risk. To maintain an appropriate product 18 level, the VFFS apparatus 5 may include one or more head level sensors 58, 60 as shown generically in FIG. 1. The head level sensors 58, 60 may be implemented as photodetectors, photo eyes, or other sensors types, including for example electromagnetic, capacitive, light, or non-visible proximity detectors. In one or more embodiments, an upper head level sensor 58 verifies that product 18 does not rise above a desired level within the film tube 28 while lower head level sensor 60 verifies that product 18 does not fall below a desired level within the film tube 28. If a macro check routine determines that both upper and lower head level sensors 58, 60 detect the presence of product 18 (overfill condition) or if neither head level sensor 58, 60 detects the presence of product 18 (underfill condition), the system may correct the dispense controller 40 settings and/or feed controller settings 42 and write those updated settings to the PLC 54 (step 308) for continued operation. In one embodiment, the macro checks are completed for each new package produced by the VFFS apparatus 5. Alternatively, the macro checks may be completed periodically, such as after a certain number of packages are produced, or each time a change is written to the PLC 54.

Once the VFFS apparatus 5 is operating as expected, the packages 8 are weighed on an ongoing basis and the weight values are used as inputs to two simultaneously operating feedback loops, indicated generally in FIG. 3 as the Indexing Average Loop and the Rolling Average loop. Generally, each loop has the capability to send SCL and pump speed adjustment settings to the PLC 54 (step 308 or step 310, respectively). Further, if a first loop initiates a change in squeeze close length and pump speed, the second loop is reset to step 300 and locked out from making any changes immediately following the changes set by the first loop. Instead, the wait time at step 302 is enforced, followed by any applicable macro checks before both loops continue operating again with the changes that were implemented by the first loop.

VI. Indexing Average Feedback Loop

Figure 4:
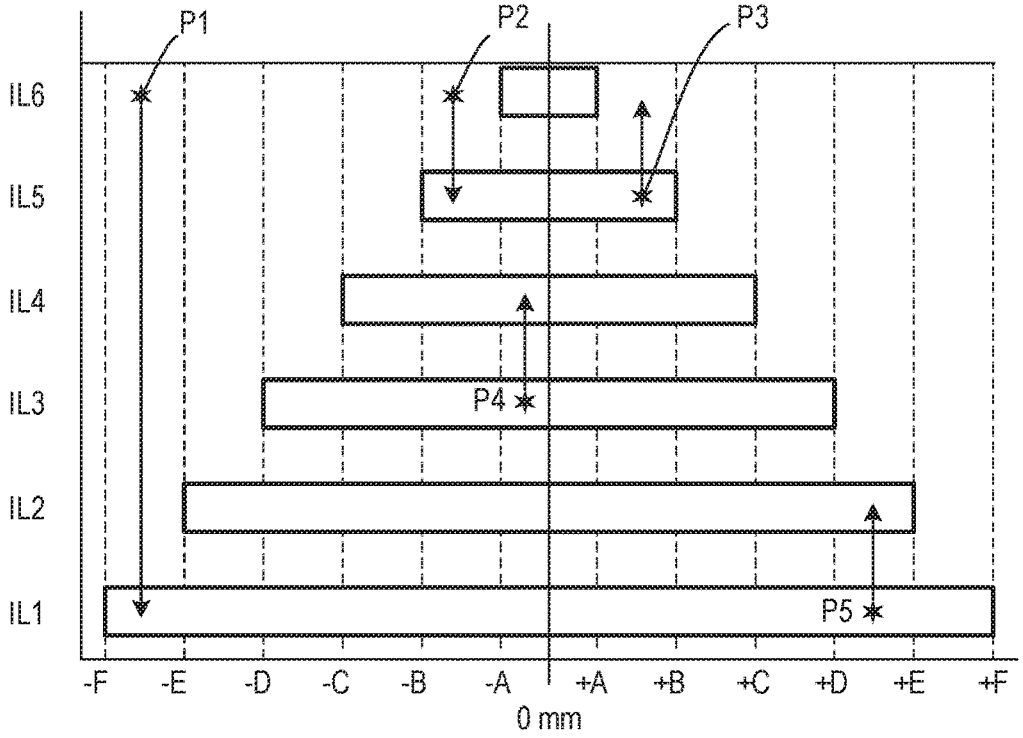
FIG. 4 is a graphical representation of package feed length tolerance levels at various index levels in accordance with some embodiments of the presently disclosed subject matter.

The Indexing Average Loop attempts to achieve stable package 8 production by gradually and incrementally adjusting the package 8 settings to meet tighter and tighter tolerances. Ideally, with minor adjustments and monitoring, the VFFS apparatus 5 will achieve a condition where the SCL, pump speed, weight, and volume reach a stable and optimal condition. Referring to FIGS. 3 and 4, the Indexing Average Loop operates in one of a plurality of discrete Index Levels. In the illustrated embodiment, the Index Levels are depicted as levels IL1 through IL6. In other embodiments, more or fewer levels may be used. Index Level 1 (IL1) represents the most uncontrolled or least stable level where package 8 weight variations are expected to vary within a large tolerance range, depicted in FIG. 4 as +/−F. Further, the tolerance ranges for the various Index Levels IL1-IL6 respectively vary between +/−F at IL1 and +/−A at IL6, with F representing the largest value and A representing the smallest value. Similarly, letters E, D, C, and B represent progressively smaller values between the maximum value F and the smallest value A. The tolerance ranges for Index Levels IL1-IL6 may represent a number of different measurable or calculable values. For instance, the tolerance levels might represent tolerance ranges for weights or average weights measured by scale 46. In one embodiment, FIG. 4 represents tolerance ranges expressed in mm, though other units of measure are contemplated.

In a preferred embodiment, at step 312 in FIG. 3, the Indexing Average Loop will average a plurality of measured weights received from the scale 46. Once the desired number of packages 8 have been weighed and averaged, a new SCL and pump speed are calculated as described above and those new settings are written to the PLC 54 to adjust the product 18 volume contained in subsequent packages 8. It may be desirable to rely on average weights (versus individual weights) for calculating the necessary adjustments because of variations in the various processes and functions carried out by the VFFS 5 and the scale 46 in producing and weighing packages 8. Furthermore, at step 312, the number of package weights that are averaged varies depending on the current Index Level. Since IL1 is represents the most uncontrolled level where package 8 weight variations are expected to vary within a large tolerance range, a relatively small number of package 8 weights are averaged before making the next adjustment at step 310. As the VFFS apparatus 5 becomes more stable and produces more repeatable package 8 weights, the Indexing Average Loop may progressively advance from a more uncontrolled Index Level, such as IL1, to more controlled Index Levels, such as IL2-IL6. Moreover, with each increasingly controlled Index Level, the Indexing Average Loop will average weights for an increasing number of packages 8.

In one embodiment, Table I below represents the number of packages that are weighed and averaged before calculating and setting a new SCL and pump speed. Table I also provides numerical values for the tolerance levels A-F shown in FIG. 4, according to one particular embodiment. Table I also shows values for the adjustment factor AF1 that may be used in equation (7) to calculate a change in squeeze close length (ΔSCL) that is based on measured package 8 weights. As indicated above, a larger adjustment factor AF1 will produce a smaller relative change in ΔSCL. Thus, while the Indexing Average Loop is running in more controlled levels (e.g., IL5 or IL6), the Adjustment Factor AF1 is the largest. Conversely, while the Indexing Average Loop is running in less controlled levels (e.g., IL1 or IL2), the Adjustment Factor AF1 is the smallest so that larger relative changes in SCL can be used to move the system towards a more stable condition. Experimentation and operation of a particular VFFS apparatus 5 may reveal that slightly different values than those shown in Table I may be appropriate.

TABLE I

Number of Packages Averaged at Each Index Level

| Index Level | Packages Averaged | Tolerance Range (mm) | Adjustment Factor AF1 |
|---|---|---|---|
| IL1 | 3 | +/−0.9 | 2.25 |
| IL2 | 5 | +/−0.7 | 2.50 |
| IL3 | 7 | +/−0.5 | 2.75 |
| IL4 | 10 | +/−0.3 | 3.00 |

TABLE I-continued

Number of Packages Averaged at Each Index Level

| Index Level | Packages Averaged | Tolerance Range (mm) | Adjustment Factor AF1 |
|---|---|---|---|
| IL5 | 15 | +/−0.2 | 3.25 |
| IL6 | 20 | +/−0.1 | 3.50 |

At a given Index Level, once the indicated number of packages 8 have been weighed and averaged, and the new SCL and pump speed are calculated (step 312) and written to the PLC 54 (step 310), the Indexing Average Loop will enter an index check at step 314 to determine at which Index Level the Indexing Average Loop should operate. At step 314, the Indexing Average Loop compares the most recently calculated change in SCL written to the PLC 54 at step 310 against the tolerance ranges in FIG. 4 to determine whether the current performance is at or better than the current Index Level. So, for example, data point P3 illustrates an example where a newly calculated change in SCL is within the expected tolerance range +/−F for current Index Level IL1. Therefore, at step 320, the Indexing Average Loop will change the current Index Level by one level from IL5 to IL6.

Data point P5 illustrates an example where a newly calculated change in SCL is within the expected tolerance range +/−F for current Index Level IL1 and also within the tighter tolerance range +/−E for Index Level IL2. Therefore, at step 320, the Indexing Average Loop will change the current Index Level by one level from IL1 to IL2. In one embodiment, the index check routine may require two or more repeat instances where the current performance is better than the current Index Level before moving to the next, more accurate Index Level at step 320. Upon repeated, improved performance, the Indexing Average Loop can ultimately operate at the most accurate index level IL6 and remain at that level as long as the performance of the VFFS 5 continues to produce packages 8 meeting the tight tolerance +/−A.

At step 320, the Index Level will improve by a single step (IL+1) regardless of how much better the current performance is than the current Index Level. So for instance, data point P4 represents a change in SCL that is within the expected tolerance level +/−D for IL3 and also within the expected tolerance ranges for each of Index Levels IL4-IL6. In spite of this good performance, the Indexing Average Loop will incrementally advance the current index level at step 320 from IL3 to IL4. Such a small adjustment is appropriate where the objective of the Indexing Average Loop is to gradually and incrementally adjust the package 8 settings to meet tighter and tighter tolerances. A large jump in index level from IL3 to IL6 before the Indexing Average Loop verifies repeated, stable performance may result in errors or faults that are not correctable until the Indexing Average Loop counts and averages 20 packages at IL6. Thus, repeatable and predictable performance benefits might be more effectively achieved by incrementally increasing the Index Levels one step at a time.

If at steps 314 and 320 the Indexing Average Loop determines that the current system performance is worse than the current index level, the index check process continues to step 322. So for instance, data point P2 illustrates an example where a newly calculated change in SCL is outside of the expected tolerance range +/−A for Index Level IL6. However, data point P2 does fall within the expected tolerance range +/−B for Index Level IL5. Therefore, at step 322, the Indexing Average Loop will move by one level from IL6 to IL5. In one embodiment, the index check routine may require two or more repeat instances where the current performance is worse than the current Index Level before moving to a less accurate Index Level at step 322. In one embodiment, the index check routine may require a single instance where the current performance is worse than the current Index Level before moving to a less accurate Index Level at step 322. A notable difference between step 320 and step 322 is that index level changes from a less accurate Index Level to a more accurate Index Level will proceed one level at a time. In contrast, at step 322, if the Indexing Average Loop determines that the current performance is worse than the current Index Level, the Indexing Average Loop may decrease the current Index Level by more than one level. So for instance, data point P1 in FIG. 4 represents a change in SCL that is well outside of the expected tolerance level +/−A for IL6. The only tolerance range this new change in SCL falls within is +/−F for Index Level IL1. Therefore, the Indexing Average Loop will change the current Index Level from IL6 to 11_1, which represents a change of five levels. Here, a rapid retreat of the Index Level is appropriate in an effort to implement necessary changes after smaller numbers of average package 8 weights. In the present example, once the new change in SCL is applied and new packages 8 are generated, a new adjustment value can be determined after the appropriate number of new packages 8 corresponding to the new Index Level (e.g., three packages for IL1).

VI. Rolling Average Feedback Loop

Figure 5:
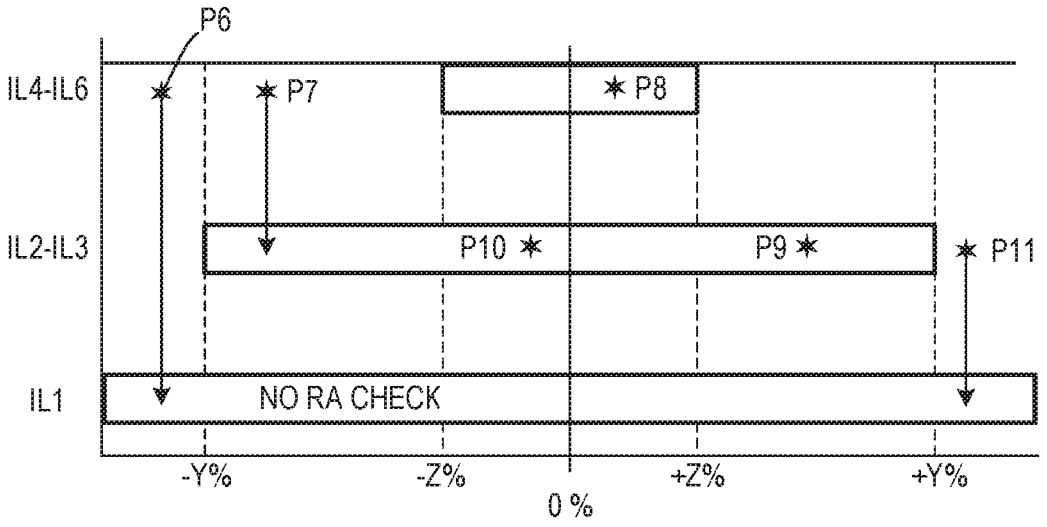
FIG. 5 is a graphical representation of package weight tolerance levels at various index levels in accordance with some embodiments of the presently disclosed subject matter.

In parallel to and independent of the Indexing Average Loop, the Rolling Average loop operates as a watchdog check to make sure that adjustments implemented by the Indexing Average Loop do not cause the VFFS apparatus 5 to become unstable or begin to operate with a worse performance. Referring to FIGS. 3 and 5, the Rolling Average Loop operates in one of a plurality of discrete Index Level ranges. In the illustrated embodiment, the Index Levels IL1 through IL6 are the same levels described above. However, the Rolling Average Loop operates in one of three levels. A first level corresponds to the most unstable Index Level IL1. A second level corresponds to intermediate Index Levels IL2-IL3. The third level corresponds to the more controlled levels IL4-IL6. In other embodiments, more or fewer levels may be used. FIG. 5 shows that at the intermediate (IL2-IL3) and controlled (IL4-IL6) Index Level ranges, a Rolling Average of multiple package 8 weights is compared against tolerance ranges depicted respectively as +/−2% and +/−Z %. In one embodiment, the Rolling Average of 3-6 package 8 weights is calculated and compared to the indicated tolerance ranges. In one embodiment, at all Index Levels, the Rolling Average of a fixed number of package 8 weights is calculated and compared to the indicated tolerance ranges. In one embodiment, the Rolling Average of varying numbers of package 8 weights is calculated and compared to the indicated tolerance ranges at different Index Levels. In a preferred embodiment, at the intermediate Index Levels IL2-IL3, a Rolling Average of three package 8 weights is calculated and compared against a tolerance of +/−2% of a desired, expected package 8 weight. Similarly, at the controlled Index Levels IL4-IL6, a Rolling Average of four package 8 weights is calculated and compared against a tolerance of +/−1% of a desired, expected package 8 weight.

Similar to the Indexing Average Loop, the Rolling Average Loop will average (at step 324) a plurality of measured weights received from the scale 46. Once the desired number of packages 8 have been weighed and averaged, a new SCL and pump speed are calculated as described above. However, those new settings are not always written to the PLC 54 by the Rolling Average Loop to adjust the product 18 volume contained in subsequent packages 8. If the current Rolling Average of package weights is better than or within the tolerance range for the current Index Level (step 326), the newly calculated values are ignored and the Rolling Average Loop simply returns to step 324 to continue averaging subsequent packages. Furthermore, the Rolling Average Loop does not seek to move the current Index Level to a more controlled Index Level. For instance, data points P8, P9, and P10 in FIG. 5 indicate that the current Rolling Average of package weights is better than or within the tolerance range for the current Index Level. Thus, after calculating and averaging the weights for data point P8, the Index Level is maintained at its current level in the range IL4-IL6 (as determined by the Indexing Average Loop). Similarly, after calculating and averaging the weights for data points P9 and P10, the Index Level is maintained at its current level in the range IL2-IL3 (also as determined by the Indexing Average Loop). Notably, even though data point P10 is good enough to fall within the tolerance range for the more controlled Index Levels (IL4-IL6), the Rolling Average Loop does not change the current Index Level.

Instead, the Rolling Average Loop will change the current Index Level towards a less controlled or more unstable Index Level if the package 8 weights indicate a run of erratic or widely varying packages 8. For instance, data points P6, P7, and P11 each indicate that the current Rolling Average of package weights are outside of the tolerance for their respective Index Level. In the case of data points P6 and P7, the current Index Level is in the range IL4-IL6 and the Rolling Average weight should be within +/−Z % of a desired weight. Data point P7 is outside of the +/−Z % tolerance range, but is within +/−Y % of the next lower, intermediate range of Index Levels IL2-IL3. Therefore, after calculating and averaging the weights for data point P7, the Index Level is changed to IL3 (step 328), and the new SCL and pump speed calculated at step 324 are written to the PLC 54 at step 308. Similar Index Level changes are applied after calculating and averaging the weights for data points P6 and P11, which are each outside of the +/−Y % tolerance range of the intermediate range of Index Levels IL2-IL3. Therefore, after calculating and averaging the weights for data points P6 and P11, the Index Level is changed to IL1 and the new SCL and pump speed calculated at step 324 are written to the PLC 54 at step 308.

At Index Level IL1, the Rolling Average may optionally perform or not perform a check against a tolerance level. As indicated, the Rolling Average Loop operates as a watchdog and only changes a current Index Level towards a less controlled level at step 328 as necessary. Thus, where IL1 is the least controlled level, the Rolling Average Loop can simply operate at step 324 until such time as the Indexing Average Loop changes the current Index Level to IL2-IL6.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For example, while adjustments to the volume of product 18 contained within individual pouches 10 have been described herein as adjustments to a squeeze close length, alternative adjustments to pouch capacity, and hence product volume, can be made. For instance, the length of a pouch 10 can be adjusted to change the volumetric capacity of each pouch 10 with product 18 filled to that capacity. The invention should therefore not be limited by the above described embodiment, method, and examples, but by all embodiments and methods within the scope and spirit of the invention as claimed.

What is claimed is:

1. A method of producing on an apparatus a plurality of product packages by adjusting on an ongoing basis a fill rate at which the product is filled and a corresponding product volume contained within a pouch, the method comprising:

while operating the apparatus in one of a plurality of index levels, forming, filling, and sealing the product packages using initial values for the fill rate and the volume, wherein each of the index levels in the plurality of index levels is associated with a different tolerance range;

measuring a weight of the product packages as they are produced by the apparatus;

in a first feedback control loop:

calculating, based in part on the measured weights, a first adjusted measure of the fill rate and a first adjusted measure of the volume;

comparing the first adjusted measure of volume against a plurality of first threshold levels, each first threshold level corresponding to one of the plurality of index levels, the first threshold levels comprising a widest first threshold range at a first index level and a narrowest first threshold range at a second index level; and in a second feedback control loop:

calculating, based in part on the measured weights, a second adjusted measure of the fill rate and a second adjusted measure of the volume;

comparing the measured weight against a plurality of second threshold levels, each second threshold level corresponding to one of the plurality of index levels, the second threshold levels comprising a widest second threshold range at the first index level and a narrowest second threshold range at the second index level;

wherein if the first adjusted measure of volume is within a first threshold level corresponding to a current index level, adjusting the apparatus using the first adjusted measure of the fill rate and the first adjusted measure of the volume and changing the index level of the apparatus in a direction from the first index level towards the second index level; and producing, by the apparatus, a new package using the changed index level of the apparatus.

2. The method of claim 1 wherein the step of operating the apparatus in one of a plurality of index levels comprises operating the apparatus in more than two index levels with at least a third index level between the first and second index levels, the first threshold levels comprising an intermediate first threshold range at the third index level that is wider than the narrowest first threshold range and wider than the narrowest first threshold range.

3. The method of claim 2 wherein the second threshold levels comprise an intermediate second threshold range at the third index level that is wider than the narrowest second threshold range and wider than the narrowest second threshold range.

4. The method of claim 2 wherein the step of changing the index level in the direction from the first index level towards the second index level comprises changing by a single index level.

5. The method of claim 1 wherein if the first adjusted measure of volume is outside of the current first threshold level corresponding to the current index level, adjusting the apparatus using the first adjusted measure of the fill rate and the first adjusted measure of the volume and changing the index level in a direction from the second index level towards the first index level.

6. The method of claim 5 wherein the step of changing the index level in the direction from the second index level towards the first index level comprises changing by one or more index levels.

7. The method of claim 1 wherein if the measured weight is outside of a current second threshold level corresponding to the current index level, adjusting the apparatus using the second adjusted measure of the fill rate and the second adjusted measure of the volume and changing the index level in a direction from the second index level towards the first index level.

8. The method of claim 1 wherein the step of calculating the first adjusted measure of the fill rate and the first adjusted measure of the volume comprises averaging a different number of the measured weights for each of the plurality of index levels, including averaging a smallest number of the measured weights at the first index level and averaging a largest number of the measured weights at the second index level.

9. The method of claim 8 wherein the step of calculating the second adjusted measure of the fill rate and the second adjusted measure of the volume comprises averaging a different number of the measured weights for each of the plurality of index levels, including averaging a smallest number of the measured weights at the first index level and averaging a largest number of the measured weights at the second index level.

10. The method of claim 9 wherein for a given index level, the step of calculating the second adjusted measure of the fill rate and the second adjusted measure of the volume comprises averaging a first number of the measured weights and the step of calculating the first adjusted measure of the fill rate and the first adjusted measure of the volume comprises averaging a larger second number of the measured weights.

11. A computer-implemented method for producing on an apparatus a plurality of product packages by adjusting on an ongoing basis a fill rate at which the product is filled and a corresponding product volume contained within a pouch, comprising executing on a processor the steps of:

while operating the apparatus in one of a plurality of index levels, forming, filling, and sealing the product packages using initial values for the fill rate and the volume, wherein each of the index levels in the plurality of index levels is associated with a different tolerance range;

measuring a weight of the product packages as they are produced by the apparatus;

in a first feedback control loop:

calculating, based in part on the measured weights, a first adjusted measure of the fill rate and a first adjusted measure of the volume;

comparing the first adjusted measure of volume against a plurality of first threshold levels, each first threshold level corresponding to one of the plurality of index levels, the first threshold levels comprising a widest first threshold range at a first index level and a narrowest first threshold range at a second index level; and in a second feedback control loop:

calculating, based in part on the measured weights, a second adjusted measure of the fill rate and a second adjusted measure of the volume;

comparing the measured weight against a plurality of second threshold levels, each second threshold level corresponding to one of the plurality of index levels, the second threshold levels comprising a widest second threshold range at the first index level and a narrowest second threshold range at the second index level; and wherein if the first adjusted measure of volume is within a first threshold level corresponding to a current index level, adjusting the apparatus using the first adjusted measure of the fill rate and the first adjusted measure of the volume and changing the index level of the apparatus by a single index level in a direction from the first index level towards the second index level; and producing, by the apparatus, a new package using the changed index level of the apparatus.

12. The method of claim 11 wherein if the first adjusted measure of volume is outside of the current first threshold level corresponding to the current index level, adjusting the apparatus using the first adjusted measure of the fill rate and the first adjusted measure of the volume and changing the index level by one or more index levels in a direction from the second index level towards the first index level.

13. The method of claim 11 wherein if the measured weight is outside of a current second threshold level corresponding to the current index level, adjusting the apparatus using the second adjusted measure of the fill rate and the second adjusted measure of the volume and changing the index level by one or more index levels in a direction from the second index level towards the first index level.

14. The method of claim 11 wherein the step of calculating the first and second adjusted measures of the fill rate and the first and second adjusted measures of the volume comprises averaging a different number of the measured weights for each of the plurality of index levels, including averaging a smallest number of the measured weights at the first index level and averaging a largest number of the measured weights at the second index level; and wherein for a given index level, the step of calculating the second adjusted measure of the fill rate and the second adjusted measure of the volume comprises averaging a first number of the measured weights and the step of calculating the first adjusted measure of the capacity and the first adjusted measure of the volume comprises averaging a larger second number of the measured weights.

15. An apparatus for producing a plurality of product packages by a process of forming product pouches from a film, filling the pouches with a product, and sealing the product pouches to form the product packages, the apparatus comprising:

a film feed controller and feed mechanism in contact with the film to advance the film a desired amount to create a pouch having a desired volumetric capacity;

a product dispense controller disposed to supply a desired, adjustable volume of product to the pouches formed from the film;

a squeeze controller and squeeze mechanism in contact with the film to restrict a flow of product supplied by the dispense controller into the pouches formed from the film;

a product package scale disposed in-line with a conveyor system that carries the product packages away from the apparatus, the product package scale measuring a weight of the product packages produced by the apparatus;

a computer processor adapted to perform the steps of:

operating a first feedback control loop and a second feedback control loop in one of a plurality of index levels, wherein each of the index levels in the plurality of index levels is associated with a different tolerance range;

receiving the weight of the product packages;

calculating, in the first feedback loop, a first average of the weights and determining a first squeeze controller adjustment, wherein the first average of the weights is based on a first number of packages;

calculating, in the second feedback loop, a second average of the weights and determining a second squeeze controller adjustment, wherein the second average of the weights is based on a second number of packages, and wherein the first number of packages is different from the second number of packages;

comparing the first squeeze controller adjustment against a plurality of first threshold levels, each first threshold level corresponding to one of the plurality of index levels, the first threshold levels comprising a widest first threshold range at a first index level and a narrowest first threshold range at a second index level; and comparing the second average of the weights against a plurality of second threshold levels, each second threshold level corresponding to one of the plurality of index levels, the second threshold levels comprising a widest second threshold range at the first index level and a narrowest second threshold range at the second index level;

wherein if the first squeeze controller adjustment is within a first threshold level corresponding to a current index level, applying the first squeeze controller adjustment to the production of new product packages and changing the index level of the apparatus by a single index level in a direction from the first index level towards the second index level; and producing, by the apparatus, a new package using the changed index level of the apparatus.

16. The apparatus of claim 15 wherein if the first squeeze controller adjustment is outside of the current first threshold level corresponding to the current index level, applying the first squeeze controller adjustment to the production of new product packages and changing the index level by one or more index levels in a direction from the second index level towards the first index level.

17. The method of claim 15 wherein if the second average of the weights is outside of a current second threshold level corresponding to the current index level, applying the second squeeze controller adjustment to the production of new product packages and changing the index level by one or more index levels in a direction from the second index level towards the first index level.

18. The apparatus of claim 17 wherein the computer processor also performs the step of:

determining, in the second feedback loop, a second product dispense controller adjustment; and wherein the step of applying the second squeeze controller adjustment to the production of new product packages further comprises applying the second product dispense controller adjustment.

19. The apparatus of claim 15 wherein the steps of calculating the first and second averages of the weights comprises averaging a different number of the measured weights at each of the plurality of index levels, including averaging a smallest number of the measured weights at the first index level and averaging a largest number of the measured weights at the second index level.

20. The apparatus of claim 19 wherein the second average of the weights is calculated from a smaller number of package weights than the first average of the weights.

21. The apparatus of claim 15 wherein the computer processor also performs the step of:

determining, in the first feedback loop, a first product dispense controller adjustment; and wherein the step of applying the first squeeze controller adjustment to the production of new product packages further comprises applying the first product dispense controller adjustment.

* * * * *